US005235343A

United States Patent [19]

Audren et al.

[11] Patent Number: 5,235,343

[45] Date of Patent: Aug. 10, 1993

[54] HIGH FREQUENCY ANTENNA WITH A VARIABLE DIRECTING RADIATION PATTERN

[75] Inventors: James Audren, Guidel; Patrice Brault, Lorient, both of France

[73] Assignee: Societe d'Etudes et de Realisation de Protection Electronique Informatique Electronique, Guidel, France

[21] Appl. No.: 748,326

[22] Filed: Aug. 21, 1991

[30] Foreign Application Priority Data

Aug. 21, 1990 [FR] France ..... 90 10528

[51] Int. Cl.[5] ..... H01Q 9/160; H01Q 19/280

[52] U.S. Cl. ..... 343/816; 343/817; 343/837

[58] Field of Search ..... 343/814–819, 343/833–838, 876, 794, 810

[56] References Cited

U.S. PATENT DOCUMENTS

| | | | |
|---|---|---|---|
| 3,213,645 | 11/1965 | Ehrenspeck | 343/819 |
| 3,521,169 | 7/1970 | Turner et al. | 343/752 |
| 3,560,978 | 2/1971 | Himmel et al. | 343/837 |
| 4,260,994 | 4/1981 | Parker | 343/876 |
| 4,631,546 | 12/1986 | Dumas et al. | 343/833 |

FOREIGN PATENT DOCUMENTS 7408632 10/1975 France .

*Primary Examiner*—William Mintel
*Assistant Examiner*—Peter Toby Brown
*Attorney, Agent, or Firm*—Ostrolenk, Faber, Gerb & Soffen

[57] ABSTRACT

The present invention relates to an antenna apparatus emitting or receiving high frequency waves and comprising four parasitic vertical rod elements disposed symmetrically to a central vertical rod element and switching elements controlled by a control circuit so that the parasitic rod elements are applied successively and periodically to the ground potential by the control circuit.

11 Claims, 3 Drawing Sheets

HIGH FREQUENCY ANTENNA WITH A VARIABLE DIRECTING RADIATION PATTERN

BACKGROUND OF THE INVENTION

The present invention relates to an antenna apparatus emitting or receiving high frequency waves with a variable directing radiation pattern by a rotation thereof.

Such apparatuses, commonly referred as having an electronic guiding, are well-known and generally consist in a plurality of antennas connected by appropriate shifting networks providing a combining or distributing circuit, the guiding consisting in varying one or several shifting networks.

However, these known apparatuses need very complicate shifting networks and a plurality of feeders.

SUMMARY OF THE INVENTION

An object of the present invention is to eliminate the above drawbacks by providing an antenna apparatus emitting or receiving high frequency waves with a variable directing radiation pattern by rotating it through a control electronic circuit, and which comprises at least three parasitic vertical conductive rod elements disposed concentrically to a fourth central vertical conductive rod element connected to a feeder wire, the parasitic rod elements being periodically applied at least individually to a ground potential by switching elements, respectively, controlled by the control circuit so that the grounded parasitic element or elements constitute with the central rod element one or several tuned doublets and the remaining parasitic element or elements not to the ground potential constitute radiation guiding elements.

Advantageously, the apparatus comprises four parasitic rod elements disposed symmetrically to the central rod element and successively applied to the ground potential by the control circuit so that the radiation pattern has a cardioid configuration.

Preferentially, the control circuit has a divider, the outputs of which deliver signals for controlling switching elements, respectively, in synchronism with a clock signal supplied to a clock input of the divider having a frequency which is a multiple of the frequency of each control signal or rotating frequency of the antenna, the clock signal having a portion resetting the divider and being transmitted to a conductive line connected to the feeder wire.

The control circuit has further a circuit for generating the clock signal including a microprocessor or a counter-decoder outputting two control signals, one intended to activate or deactivate a transistor at a frequency which is a multiple of the rotating frequency of the antenna and the other intended to activate another transistor during a duration corresponding to said multiple of the rotating frequency of the antenna at each rotating period of the antenna, the collectors of the two transistors being connected in common and an emitter-follower transistor, the base of which is controlled by the collectors connected in common of the two other transistors and supplying to said transmitting line the clock signal having a low voltage level constituting the resetting portion of the divider applied to the latter through a resetting transistor, followed by high voltage levels supplied to the clock input of the divider through a transistor put at a saturation state by these high levels.

The apparatus further comprises two inductors of sufficient magnitudes to isolate the high frequency signal passing through said transmitting line of the circuit controlling the switching elements.

Advantageously, the switching elements are constituted by diodes, the cathodes of which are connected in common to the ground potential and the anodes are connected to the lower ends of the parasitic rod elements, respectively, which are also connected to the outputs of the divider, respectively, of the control circuit through resistors.

BRIEF DESCRIPTION OF THE DRAWINGS

For a fuller understanding of the invention, reference is made to the following description, taken in connection with the accompanying drawings, in which.

DETAILED DESCRIPTION OF THE INVENTION

Figure 1:
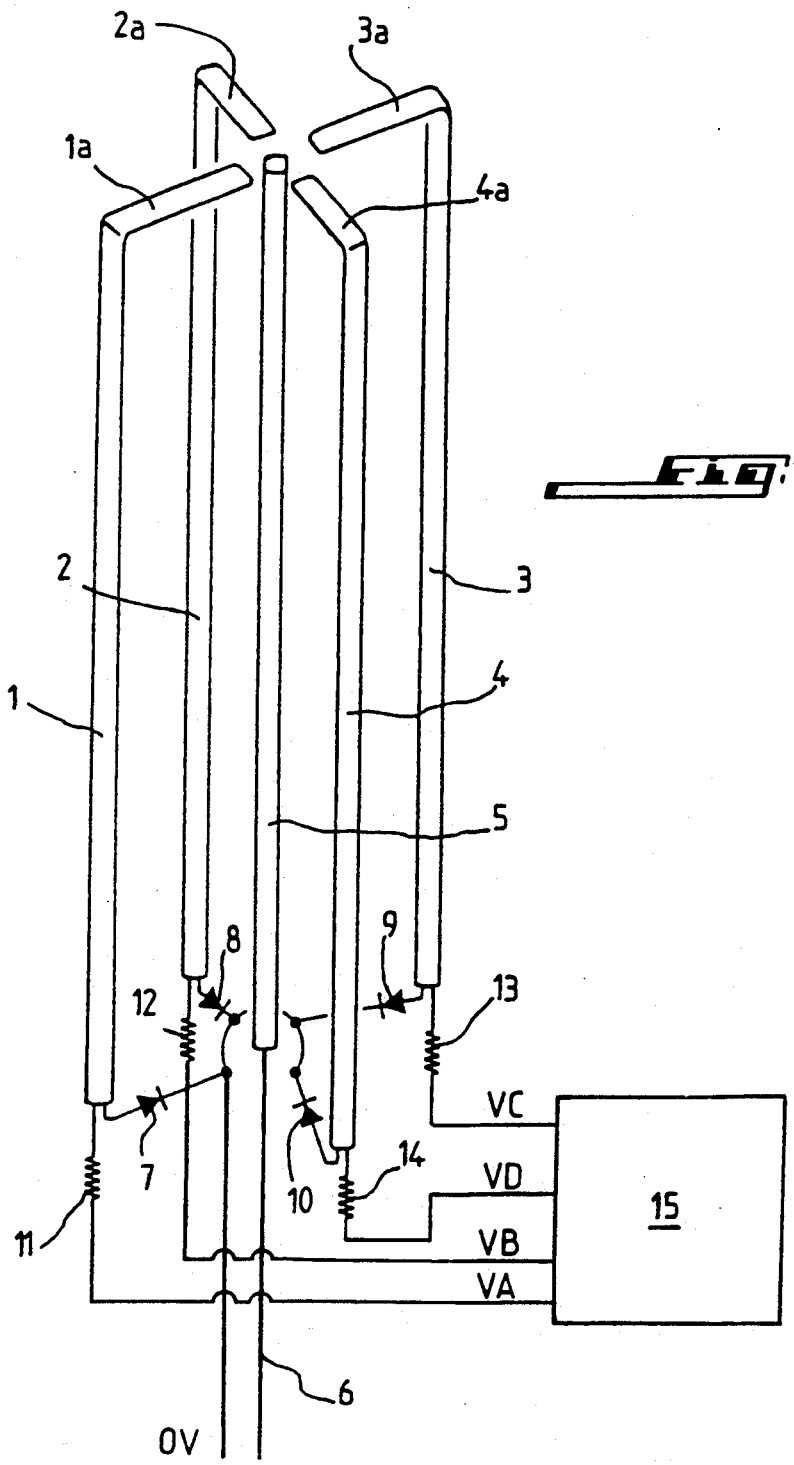
FIG. 1 is a perspective schematic view of the antenna according to the invention associated with a control circuit.
Figure 2:
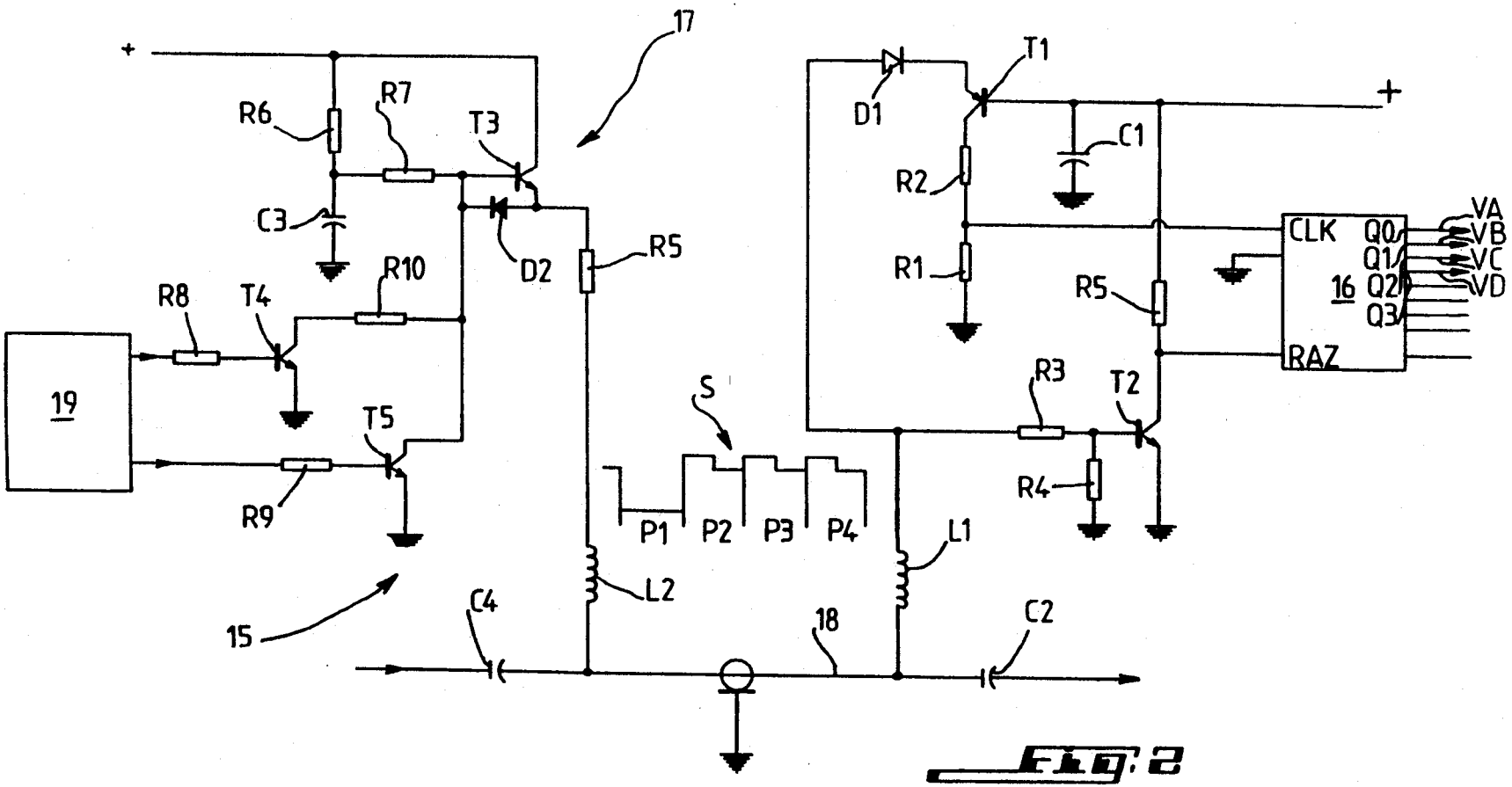
FIG. 2 is an electronic diagram of the control circuit.
Figure 3:
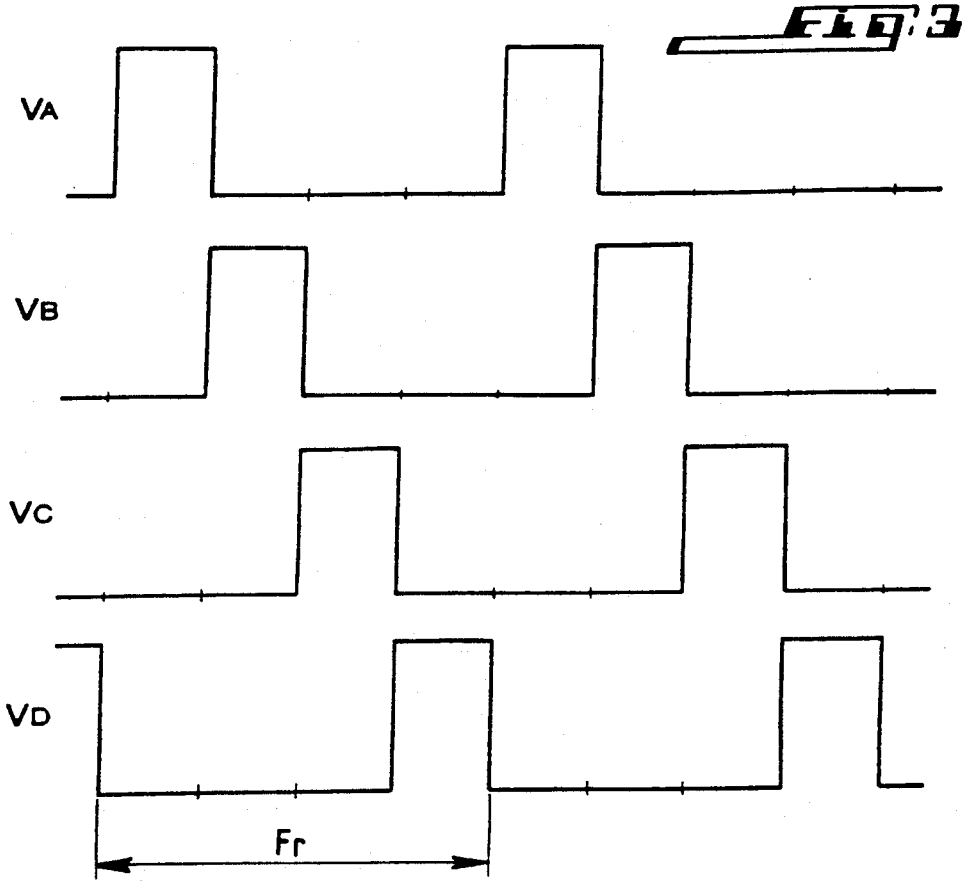
FIG. 3 shows control signals of switching elements associated with the antenna.

Referring to the Figures, the antenna according to the invention, used as a radiogoniometer, comprises preferentially four parasitic conductive and vertical rod elements 1–4 disposed symmetrically to a central vertical and conductive rod element (5) closely to the latter, for example at a distance of 0.14 λ thereof, where λ is the wave length of the high frequency signal emitted or received by the antenna. The length of each vertical rod element 1–4 corresponds to ¼ λ. The central rod element 5 has its lower end connected electrically to a feeder wire 6 connected to an emitter or a receiver (not shown) of the high frequency signal. The parasitic rod elements 1–4 have each of their upper ends prolongated by a horizontal portion **1*a*–4*a* directed towards the upper end of the central rod element 5 so as to increase the capacitance of the central rod element 5 with respect to each surrounding parasitic rod element 1–4. The lower ends of the parasitic rod elements 1–4 are connected to the anodes, respectively, of four diodes having a variable capacitance 7–10, the cathodes of which are connected in common to a ground potential (0 volt). The lower ends of the rod elements 1–4 are also connected to resistors 11–14, respectively, the terminals of which opposite to the terminals connected to the rod elements 1–4 are connected to four outputs, respectively, of an electronic control circuit 15. The circuit 15 is adapted to periodically supply signals VA, VB, VC, VD controlling the diodes 7–10, respectively, through the resistors 11–14 so as to render the diodes 7–10 successively conductive and thus to apply successively the parasitic rod elements 1–4** to the ground potential.

The control circuit 15 comprises an octal divider 16, known per se, the outputs Q0 to Q3 of which supply respectively the control signals VA to VD of the diodes 7–10 through the resistors 11–14 in synchronism with a clock signal S generated from a generating circuit 17 which will be described later. The clock input CLK of the divider 16 is connected to the common junction of two resistors R1 and R2, the resistor R1 having its other terminal connected to the ground whereas the other terminal of the resistance R2 is connected to the collector of a transistor T1, the base of which is connected to a power supply positive potential and to a terminal of a capacitor C1, the other terminal of which is connected to the ground. The emitter of transistor T1 is connected to the cathode of a diode D1 intended to protect the base-emitter path of transistor T1 from a reverse biasing. The anode of the diode D1 is connected to a resistor R3 also connected to the base of a transistor T2 intended to reset the divider 16. A resistor R4 is connected between the base of transistor T2 and the ground. The transistor T2 has its emitter connected to the ground and its collector connected to the reset input of divider 16. A resistor R5 also connects the collector of transistor T2 to the power supply positive potential. An inductor L1 connects the anode of the diode D1 to a central conductor (18) of a coaxial cable, which conductor (18) is connected to the feeder wire 6 through, if necessary, a capacitor C2.

The generating circuit 17 comprises an emitter-follower transistor T3 and a diode D2 protecting the base-emitter junction of transistor T3, the emitter of which is connected to a resistor R5 in series with an inductor L2 connected to the conductor 18. The collector of transistor T3 is connected to the power supply positive potential and to a resistor R6, the other terminal of which is connected on one hand to a capacitor C3 having its other terminal to the ground and on the other hand to a resistor R7 having its other terminal connected to the base of transistor T3. The base of transistor T3 is thus connected through the resistor R7 to a power supply decoupled by the capacitor C3 and activated by the resistor R6 from the main power supply. The circuit 17 further comprises two transistors T4 and T5, the bases of which are connected to two resistors R8 and R9, respectively. The collector of transistor T4 is connected to a resistor R10 having its other terminal connected to the base of transistor T3 whereas the transistor T5 has its collector connected directly to the base of transistor T3. The transistors T4 and T5 have their emitters connected to the ground. The bases of transistors T4 and T5 are controlled through resistors R8 and R9 by signals from a circuit 19, which may be constituted by a microprocessor or a counter-decoder. More precisely, the circuit 19 is adapted to activate or deactivate the transistor T4 by a signal having a frequency which is four times greater than the rotating frequency Fr of the antenna or the frequency of each control signal VA, VB, VC and VD controlling the diodes 7–10. The circuit 19 is further adapted to activate the transistor T5 by a signal during a duration corresponding to four times the rotating frequency Fr of the antenna at each complete rotation of the antenna, i.e. the transistor T5 is activated once every rotation of the antenna during a quarter period of the rotation period. By selecting correctly the magnitudes of resistors R6, R7 and R10, the voltage to the conductor 18 has the shape of the signal S. Thus, the signal S has a portion P1 of a voltage level of approximately 0 volt and of a period equal to the quarter of a period corresponding to the frequency Fr and three clock portions P2–P4, each of a period corresponding to four times the frequency Fr. To the end of the conductor 18, in the vicinity of the antenna, the inductor L1 supplies the circuit generating the control signals VA–VD; the central conductor 18 of the coaxial cable being further connected to the emitter or the receiver of the high frequency signals through a capacitor C4. The magnitude of each inductor L1 and L2 must be sufficient to isolate the high frequency signal passing through the conductor 18 of the circuit 15.

The operation of the control circuit of the antenna is already apparent from the description made hereabove and will be now explained briefly.

The circuit 19 drives the bases of transistors T4 and T5 by the signals defined hereabove and the base of transistor T3 is controlled by the collectors of transistors T4 and T5 so as to supply through the resistor R5 and the inductor L2 the signal S. The current flowing from the inductor L1, through the diode D1 and the transistor T1, loads the supply line of the capacitor C1 to a voltage close to the initial supply voltage, which in fact is the voltage across the capacitor C3 minus the three diode voltage drops during the three higher voltages levels of the portions P2, P4 of the signal S. During the three high levels, the transistor T1 is at a saturation state and supplies three clock signals to the divider 16 through the resistors R1 and R2. During the low voltage period of the portion Q1 of the signal S, the transistor T2 is deactivated because its base voltage from the resistors R3 and R4 is too low. The deactivated transistor T2 then supplies a positive pulse to reset the divider 16 so as to thus accommodate a sequence of the outputs Q0, Q1, Q2, Q3 of the divider 16 is synchronism with the wave form of the signal S. Thus, at the reset time of the divider 16, the output Q0 thereof supplies the control voltage VA of the diode 7, the outputs Q1 to Q3 being at the 0 volt potential. At the occurrence of the first clock pulse applied to the divider 16, the output Q1 thereof supplies the control signal VB of the diode 8 at the same time the control signal VA terminates, the outputs Q2 and Q3 being always at the potential of 0 volt. At the occurrence of the second clock pulse, the output Q2 supplies the control signal VC of the diode 9 at the same time the control signal VB terminates, the outputs Q0 and Q3 being at 0 volt. At the occurrence of the third clock pulse, the output Q3 of the divider 16 supplies the control voltage VD of the diode 10 at the same time the control signal VC terminates with the outputs Q0 and Q1 at the potential of 0 volt.

Figure 4:
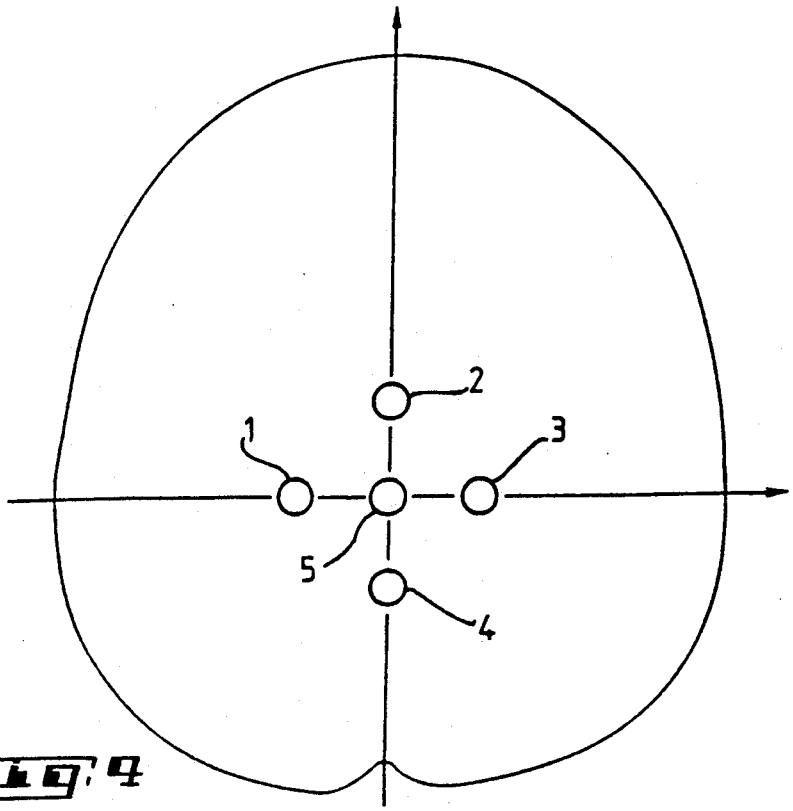
FIG. 4 shows the radiation pattern of the antenna of FIG. 1.

The diodes 7 to 10 are thus biased successively to a conductive condition or a high capacitance condition by the control signals VA to VD, respectively, at the frequency of each of these signals or the rotation frequency Fr of the antenna. Under such circumstances, the parasitic rod elements 1–4 of the antenna are successively applied to the ground at the frequency of the control signals VA–VD. Thus, when the rod element 1 is grounded, it constitutes with the central rod element 5 a tuned doublet or a tuned loop antenna because of the capacitance encountered at the level of the end of the rod elements 1 and 5. The rod element 3, diametrically opposite to the rod element 1, operates as a parasitic guiding element, which is electrically short (with regard to its effective length) and spaced at a distance of 0.14 λ from the active antenna constituted by the rod elements 1 and 5. If we consider the antenna as an emitting antenna, the major part of the energization or excitation due to the radiating field and directed towards the rod element 3 comes from the central rod element 5 because the rod element 3 is much closer to the rod element 5 than the rod element 1 constituting a tuned doublet with the rod element 5. Conversely, the rod elements 2 and 4 receive an important energization of the radiating field from the rod element 1, which tends to cancel the excitation coming from the central rod elements 5 and, consequently, the effect from the parasitic rod elements 2 and 4 on the field distribution is less important than the effect from the rod element 3. This has for result that the radiation pattern has a cardioid shape as shown in FIG. 4 when the rod elements 1 and 5 constitute a tuned doublet. By switching by turns the diodes 7 to 10, a rotation of the cardioid by increments of 90° is provided with of course an appropriate duration of each control signal VA–VB.

The antenna has been described as comprising four parasitic rod elements around a central rod element but it is understood that the antenna may comprise three vertical parasitic rod elements disposed concentrically to the central vertical rod element so as to be equidistant from each other by 120° with three switching diodes associated with three parasitic rod elements, respectively, and controlled by the control circuit 15, the divider of which would supply to three outputs Q0 to Q3 the three control signals VA–VC intended to switch the corresponding diodes so as to allow a rotation of the radiating pattern by increments of 120°. In such cases, when one of the parasitic rod elements will be applied to the ground, the two other parasitic rod elements in the air will behave like guiding elements. It is further to be noted that the clock signal S will have a reset portion P1 of the divider 16 having a duration equal to the third of the rotating period of the antenna and two high level portions P2 and P3 having a frequency which is three times the frequency Fr.

The antenna can further operate with more than four parasitic rod elements around the central rod elements without departing from the present invention.

Moreover, the antenna can also operate by switching to the conductive condition three diodes with the remaining diode, in the case of four diodes associated with four parasitic rod elements, respectively, in a blocking condition, or with two adjacent diodes in a conductive condition and the two other diodes in a blocking condition.

On the other hand, the antenna may be used in a reverse position with respect to the position shown in FIG. 1 if needed as it is for example the case when used on planes, helicopters, etc. . . . Finally, the clock signal S instead of being transmitted through the conductive wire 18 to the divider 16 through the inductors L1 and L2 and the transistors T1 and T2, may be transmitted through an independent conductive wire not connected to the feeder wire 6.

However, among all the possible modifications of the antenna according to the invention, the best embodiment is the one as described with reference to the FIGS. 1 to 4.

The antenna according to the invention has thus for advantage in that it does not require a ground plane, needs only one feeder and is electronically guided by switching elements controlled by an electronic circuit of a relatively simple design, and the diodes constituting the switching elements may be replaced by transistors, field effect transistors, or relays.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An antenna apparatus emitting or receiving high frequency waves with a variable directing radiation pattern by a rotation thereof through an electronic control circuit, comprising at least three parasitic conductive and vertical rod elements disposed concentrically to a central conductive and vertical rod element connected to a feeder wire, wherein the parasitic rod elements are applied periodically at least individually to a ground potential by switching elements, respectively, which are controlled by the control circuit so that the parasitic rod element or elements applied to the ground potential constitute with the central rod element a tuned doublet or tuned doublets, respectively, and the remaining parasitic rod element or elements not grounded constitute radiation guiding elements, the parasitic rod elements are located at a distance from the central rod element equal to 0.14 λ and each parasitic rod element and the central rod element have a length equal to ¼λ where λ is the wavelength, and wherein the parasitic rod elements have each of their upper ends prolongated by a horizontal portion, not included in the length of each parasitic rod element, and directed towards the central rod element so as to increase the capacitance of the latter with respect to each parasitic rod element.

2. An antenna apparatus according to claim 1, wherein four parasitic rod elements are provided, said four parasitic rod elements disposed symmetrically to the central errod element and successively applied to the ground by the control circuit controlling four switching element so that the radiation pattern has a cardioid configuration.

3. An antenna apparatus according to claim 1, wherein said control circuit includes a divider, the outputs of which supply the control signals to said switching elements, respectively, in synchronism with a clock signal applied to a clock input of the divider having a frequency which is a multiple of the frequency of search control signal, the frequency of each control signal constituting the rotation frequency of the antenna apparatus, the clock signals having a signal portion to reset the divider and being transmitted to a conductive line connected to the feeder wire.

4. An antenna apparatus according to claim 3, wherein the control circuit further includes a circuit for generating the clock signals and having a means or supplying two control signals, one intended to activate or deactivate a first transistor at a frequency which is a multiple of the rotation frequency of the antenna apparatus and the other intended to activate a second transistor during a duration corresponding to the multiple of the rotation frequency of the antenna apparatus at each rotating period of the antenna apparatus, the first and second transistors having their collectors connected in common and an emitter-follower transistor, the base of which is controlled by the collectors in common of the first and second transistors and supplying to the conductive in the clock signal having a low voltage level constituting the reset portion of the divider applied to the latter by a reset transistor, followed by high voltage levels applied to the cock input of the divider by a third transistor saturated by these high levels.

5. An antenna apparatus according to claim 3, further comprising two inductors having a magnitude sufficient to isolate the high frequency signal flowing through said conductive line of the control circuit.

6. An antenna apparatus according to claim 3, wherein said switching elements are constituted by diodes, the cathodes of which are connected in common to the ground potential and the anodes are connected to the lower ends, respectively, of the parasitic rod elements, said lower ends being further connected to outputs, respectively, of the divider through resistors.

7. An antenna apparatus according to claim 1, wherein said antenna apparatus is sued as a radiogoniometer.

8. Antenna apparatus according to claim 4, wherein said supplying means is a microprocessor.

9. An antenna apparatus according to claim 4, wherein said supplying means is a counter-decoder.

10. An antenna apparatus emitting or receiving high frequency waves with a variable directing radiation pattern by a rotation thereof through an electronic control circuit, comprising at least three parasitic conductive and vertical rod elements disposed concentrically to a central conductive and vertical rod element connected to a feeder wire, wherein the parasitic rod elements are applied periodically at least individually to a ground potential by switching elements, respectively, which are controlled by the control circuit so that the parasitic rod element or elements applied to the ground potential constitute with the central rod element a tuned doublet or tuned doublets, respectively, and the remaining parasitic rod element or elements not grounded constitute radiation guiding elements, the parasitic rod elements are located at a distance from the central rod element equal to 0.14 λ and each parasitic rod element and the central rod element has a length equal to ¼λ where λ is the wavelength, wherein the parasitic rod elements have each of their upper ends prolongated by a horizontal portion not included in the length of each parasitic rod element, and wherein said control circuit includes a divider, the outputs of which supply the control signals to said switching elements, respectively, in synchronism with a clock signal applied to a clock input of the divider having a frequency which is a multiple of the frequency of each control signal, the frequency of each control signal constituting the rotation frequency of the antenna apparatus, the clock signals having a signal portion to reset the divider and being transmitted to a conductive line connected to the feeder wire.

11. An antenna apparatus emitting or receiving high frequency waves with a variable directing radiation pattern by a rotation thereof through an electronic control circuit comprising four parasitic conductive and vertical rod elements disposed concentrically to a central conductive and vertical rod element connected to a feeder wire, wherein the parasitic rod elements are applied periodically at least individually to a ground potential by switching elements, respectively, which are controlled by the control circuit so that the parasitic rod element or elements applied to the ground potential constitute with the central rod element a tuned doublet or tuned doublets, respectively, and the remaining parasitic rod element or elements not grounded constitute radiation guiding elements, the parasitic rod elements are located t a distance from the central rod element equal to 0.14 λ and each parasitic rod element and the central rod element has a length equal to ¼λ where λ is the wavelength, wherein the parasitic rod elements have each of their upper ends prolongated by a horizontal portion not included in the length of each parasitic rod element, and directed towards the central rod element so as to increase the capacitance of the latter with respect to each parasitic rod element, the four parasitic rod elements are disposed symmetrically to the central rod element and successively applied to the ground by the control circuit controlling four switching elements so that the radiation pattern has a cardioid configuration, and wherein said control circuit includes a divider, the outputs of which supply the control signals to said switching elements, respectively, in synchronism with a clock signal applied to a clock input of the divider having a frequency which is a multiple of the frequency of each control signal, the frequency of each control signal constituting the rotation frequency of the antenna apparatus, the clock signals having a signal portion to reset the divider and being transmitted to a conductive line connected to the feeder wire.

* * * * *

UNITED STATES PATENT AND TRADEMARK OFFICE

CERTIFICATE OF CORRECTION

PATENT NO. : 5,235,343

DATED : August 10, 1993

INVENTOR(S) : Audren et al.

It is certified that error appears in the above-indentified patent and that said Letters Patent is hereby corrected as shown below:

| | | | | |
|---|---|---|---|---|
| Column 6, | line 33, | change | "search" | to --each--. |
| Column 6, | line 41, | change | "or" | to --for--. |
| Column 6, | line 53, | change | "in" | to --line--. |
| Column 7, | line 2, | change | "sued" | to --used--. |
| Column 7, | line 4, | change | "Antenna" | to --An antenna--. |
| Column 7, | line 13, | after | "a" | insert --fourth--. |

Signed and Sealed this

Fifth Day of July, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,235,343

DATED : August 10, 1993

INVENTOR(S) : Audren et al

It is certified that error appears in the above-indentified patent and that said Letters Patent is hereby corrected as shown below:

On the title page, Assignee should read --SOCIETE D'ETUDES ET DE REALISATION ELECTRONIQUE INFORMATIQUE ELECTRONIQUE SECURITE MARITIME S.E.R.P.E.-I.E.S.M."

Signed and Sealed this

Second Day of August, 1994

*Attest:*

Bruce Lehman

BRUCE LEHMAN

*Attesting Officer*

*Commissioner of Patents and Trademarks*